US012127656B2

(12) United States Patent
Beaumont et al.

(10) Patent No.: US 12,127,656 B2
(45) Date of Patent: Oct. 29, 2024

(54) HAIR STYLING APPLIANCE

(71) Applicant: Dyson Technology Limited, Wiltshire (GB)

(72) Inventors: Rory William Beaumont, Bristol (GB); Stephen Benjamin Courtney, Gloucester (GB); Maurizio Ballarati, Swindon (GB); Alexander Edward Hughes, Swindon (GB); Robert Mark Brett Coulton, Bristol (GB); Nathan Haruna Waters Imhasly, Bath (GB)

(73) Assignee: Dyson Technology Limited, Malmesbury (GB)

( * ) Notice: Subject to any disclaimer, the term of this patent is extended or adjusted under 35 U.S.C. 154(b) by 320 days.

(21) Appl. No.: 17/438,323

(22) PCT Filed: Feb. 25, 2020

(86) PCT No.: PCT/GB2020/050443
§ 371 (c)(1),
(2) Date: Sep. 10, 2021

(87) PCT Pub. No.: WO2020/193939
PCT Pub. Date: Oct. 1, 2020

(65) Prior Publication Data

US 2022/0183438 A1 Jun. 16, 2022

(30) Foreign Application Priority Data

Mar. 22, 2019 (GB) ..... 1903958

(51) Int. Cl.
*A45D 1/04* (2006.01)
*A45D 2/00* (2006.01)
*A45D 20/12* (2006.01)

(52) U.S. Cl.
CPC ..... *A45D 20/12* (2013.01); *A45D 1/04* (2013.01); *A45D 2/001* (2013.01); *A45D 2001/045* (2013.01)

(58) Field of Classification Search
CPC ..... A45D 2001/008; A45D 1/04; A45D 1/06; A45D 1/08; A45D 2/001; A45D 20/12
See application file for complete search history.

(56) References Cited

U.S. PATENT DOCUMENTS 5,799,671 A 9/1998 Takimae
7,465,904 B2 12/2008 Kim et al.
(Continued)

FOREIGN PATENT DOCUMENTS

AU 2005242164 C1 1/2009
CA 2755141 A1 9/2010
(Continued)

OTHER PUBLICATIONS

Office Action received for Japanese Patent Application No. 2021-556858, mailed on Oct. 3, 2022, 6 pages (3 pages of English Translation and 3 pages of Original Document).
(Continued)

*Primary Examiner* — Rachel R Steitz
(74) *Attorney, Agent, or Firm* — Tucker Ellis LLP

(57) ABSTRACT

A hair straightening apparatus having two arms pivotably coupled together and arranged to receive hair within a cavity formed between them is disclosed. A plenum in at least one arm includes an air inlet for receiving airflow from a fan unit and an air outlet for emitting airflow towards hair within the cavity. The air outlet extends along the inner wall of at least one of the first arm and the second arm and is adapted to direct airflow towards a lower edge of the arms.

19 Claims, 7 Drawing Sheets

(56) References Cited

U.S. PATENT DOCUMENTS

| | | | |
|---|---|---|---|
| 8,607,470 | B2 | 12/2013 | Richmond et al. |
| 8,915,256 | B2 | 12/2014 | Klava |
| 9,012,813 | B2 | 4/2015 | Mourad |
| 9,149,101 | B2 | 10/2015 | Richmond et al. |
| 9,788,624 | B2 | 10/2017 | Weatherly et al. |
| 2005/0224091 | A1 | 10/2005 | Cafaro et al. |
| 2006/0196523 | A1 | 9/2006 | Choi |
| 2006/0201527 | A1 | 9/2006 | Higgins et al. |
| 2007/0240731 | A1 | 10/2007 | Mukai |
| 2010/0089413 | A1 | 4/2010 | Wright et al. |
| 2010/0170883 | A1 | 7/2010 | Legrain et al. |
| 2010/0242985 | A1 | 9/2010 | Kaizuka |
| 2012/0024311 | A1 | 2/2012 | Linglin et al. |
| 2013/0160316 | A1 | 6/2013 | Hadden |
| 2013/0186422 | A1 | 7/2013 | Klava |
| 2013/0247404 | A1 | 9/2013 | Garin et al. |
| 2013/0247407 | A1 | 9/2013 | Richmond et al. |
| 2014/0130365 | A1 | 5/2014 | Dineen |
| 2014/0216493 | A1 | 8/2014 | Hadden |
| 2014/0332023 | A1 | 11/2014 | Kaizuka |
| 2015/0150350 | A1 | 6/2015 | Kock |
| 2015/0189967 | A1 | 7/2015 | McNeeley et al. |
| 2015/0216280 | A1 | 8/2015 | Sayers et al. |
| 2015/0327650 | A1 | 11/2015 | Fereyre |
| 2016/0309868 | A1 | 10/2016 | Parris et al. |
| 2017/0095050 | A1* | 4/2017 | Dineen ..... A45D 20/50 |
| 2017/0135457 | A1 | 5/2017 | Ngo et al. |
| 2017/0164707 | A1 | 6/2017 | Cowdry et al. |
| 2017/0273422 | A1 | 9/2017 | Heffer et al. |
| 2017/0273426 | A1 | 9/2017 | Thompson et al. |
| 2018/0055178 | A1 | 3/2018 | Alberti |
| 2018/0140070 | A1 | 5/2018 | Hillebrecht et al. |
| 2019/0387857 | A1 | 12/2019 | Lim |
| 2022/0160092 | A1 | 5/2022 | Beaumont et al. |

FOREIGN PATENT DOCUMENTS

| | | | |
|---|---|---|---|
| CN | 2565305 | Y | 8/2003 |
| CN | 2904744 | Y | 5/2007 |
| CN | 101232836 | A | 7/2008 |
| CN | 101242754 | A | 8/2008 |
| CN | 202800496 | U | 3/2013 |
| CN | 103732098 | A | 4/2014 |
| CN | 204812557 | U | 12/2015 |
| CN | 105942698 | A | 9/2016 |
| CN | 205568163 | U | 9/2016 |
| CN | 205624975 | U | 10/2016 |
| CN | 205624981 | U | 10/2016 |
| CN | 205641527 | U | 10/2016 |
| CN | 106455781 | A | 2/2017 |
| CN | 106852572 | A | 6/2017 |
| CN | 107105858 | A | 8/2017 |
| CN | 107224080 | A | 10/2017 |
| CN | 107259761 | A | 10/2017 |
| CN | 207270050 | U | 4/2018 |
| CN | 108078141 | A | 5/2018 |
| CN | 108778044 | A | 11/2018 |
| CN | 109965481 | A | 7/2019 |
| CN | 209171516 | U | 7/2019 |
| CN | 110301736 | A | 10/2019 |
| CN | 110876521 | A | 3/2020 |
| CN | 211130014 | U | 7/2020 |
| DE | 20119863 | U1 | 4/2003 |
| DE | 202009001872 | | 7/2010 |
| DE | 102012210275 | A1 | 12/2013 |
| DE | 202013105507 | U1 | 3/2015 |
| EP | 2397045 | A1 | 12/2011 |
| EP | 2399481 | | 12/2011 |
| EP | 2433519 | A1 | 3/2012 |
| EP | 2584930 | B1 | 3/2014 |
| EP | 2734076 | A1 | 5/2014 |
| EP | 2861100 | A1 | 4/2015 |
| EP | 2624719 | B1 | 1/2016 |
| EP | 2759224 | B1 | 1/2016 |
| EP | 2888970 | B1 | 8/2016 |
| EP | 2378916 | B1 | 8/2017 |
| EP | 2717735 | B1 | 8/2017 |
| EP | 2725938 | B1 | 8/2017 |
| EP | 2861097 | B1 | 8/2018 |
| EP | 3065589 | B1 | 10/2018 |
| FR | 2937839 | | 5/2010 |
| GB | 2505171 | | 2/2014 |
| GB | 2545233 | A | 6/2017 |
| GB | 2582559 | A | 9/2020 |
| JP | 62-139990 | U | 9/1987 |
| JP | 03-027401 | U | 3/1991 |
| JP | 06-025205 | Y2 | 7/1994 |
| JP | 3350903 | B1 | 11/2002 |
| JP | 2003-125836 | A | 5/2003 |
| JP | 2004-216179 | A | 8/2004 |
| JP | 2004-223279 | | 8/2004 |
| JP | 4076128 | B2 | 4/2008 |
| JP | 4138385 | B2 | 8/2008 |
| JP | 4485118 | B2 | 6/2010 |
| JP | 4587372 | B2 | 11/2010 |
| JP | 5392948 | B2 | 1/2014 |
| JP | 5623185 | B2 | 11/2014 |
| JP | 6055315 | B2 | 12/2016 |
| JP | 2017-170145 | A | 9/2017 |
| KR | 20-0394534 | Y1 | 9/2005 |
| KR | 10-1036422 | B1 | 5/2011 |
| KR | 10-1093394 | B1 | 12/2011 |
| KR | 10-1827166 | | 2/2018 |
| KR | 10-0865865 | | 10/2018 |
| KR | 10-2019-0054015 | A | 5/2019 |
| TW | M507208 | U | 8/2015 |
| WO | 2007/022600 | A1 | 3/2007 |
| WO | 2012/127948 | A1 | 9/2012 |
| WO | 2013/013965 | A1 | 1/2013 |
| WO | 2013/104903 | A2 | 7/2013 |
| WO | 2013/189788 | A1 | 12/2013 |
| WO | 2015/088058 | A1 | 6/2015 |
| WO | 2017/163066 | A1 | 9/2017 |
| WO | 2019/077338 | A1 | 4/2019 |
| WO | 2021/072984 | A1 | 4/2021 |

OTHER PUBLICATIONS

Office Action received for Chinese Patent Application No. 202010200537.8, mailed on Nov. 18, 2022, 14 pages (8 pages of English Translation and 6 pages of Original Document).

Office Action received for GB Application No. 1903959.3, mailed on Sep. 29, 2022, 2 pages.

Office Action received for Chinese Patent Application No. 202010200533.X, mailed on Nov. 1, 2022, 19 pages (10 pages of English Translation and 9 pages of Original Document).

Combined Search and Examination Report under Sections 17 and 18(3) Received for GB Application No. 1903958, mailed on Sep. 9, 2019, 7 pages.

GB Search Report received for GB Application No. 1903959, mailed on Sep. 6, 2019, 2 pages.

International Search Report and Written Opinion received for PCT Patent Application No. PCT/GB2020/050443, mailed on Apr. 29, 2020, 10 pages.

International Search Report and Written Opinion received for PCT Patent Application No. PCT/GB2020/050444, mailed on Apr. 28, 2020, 9 pages.

Search Report Received for CN Application No. 202020367876.0, mailed on Jul. 1, 2021, 4 pages (Original Document Only).

Examination Report received for GB Application No. 1903959.3, mailed on Feb. 24, 2023, 2 pages.

Office Action received for Korean Patent Application No. 10-2021-7034219, mailed on (5 pages of English Translation and 5 pages of Original Document). Jan. 27, 2023, 10 pages.

Office Action received for Japanese Patent Application No. 2021-556853, mailed on Oct. 3, 2022, 9 pages (5 pages of English Translation and 4 pages of Original Document).

International Search Report and Written Opinion received for PCT Patent Application No. PCT/GB2022/051322, mailed on Aug. 25, 2022, 10 pages.

(56) References Cited

OTHER PUBLICATIONS

Office Action received for Chinese Patent Application No. 202010200533.X, mailed on Nov. 20, 2023, 18 pages (10 pages of English Translation and 8 pages of Original Document).
Search Report received for GB Application No. 2109089.9, mailed on Oct. 19, 2021, 2 pages.
Revlon Pro Collection Salon 360 Surround Hair Dryer, Sep. 2017, 8 pages.
Lucy Morris, "Revlon have Created a 2-in-1 Hybrid Hairdryer and Straightener", Grazia, Sep. 12, 2017, https://graziadaily.co.uk/beauty-hair/hair/revlon-pro-collection-360-surround-styler/, 3 pages.
Tina Ferraro, "Drugstore Diamond: Revlon Salon 360 Surround AC Styler Blow-Dryer Review," Teen Vogue, Sep. 30, 2017, https://www.teenvogue.com/story/revlon-salon-360-surround-ac-styler-blow-dryer-review, 3 pages.
Revlon Pro Collection Salon 360 Surround Hair Dryer, Operating Instructions, Nov. 15, 2017, 2 pages.

* cited by examiner

HAIR STYLING APPLIANCE

CROSS-REFERENCE TO PRIOR APPLICATION

This application is a § 371 National Stage Application of PCT International Application No. PCT/GB2020/050443 filed Feb. 25, 2020, which claims the priority of United Kingdom Application No. 1903958.5, filed Mar. 22, 2019, each of which are herein incorporated by reference in their entirety.

TECHNICAL FIELD AND BACKGROUND

The present invention relates to a hair styling appliance. Heated hair styling appliances are designed to use the action of heat and mechanical means and airflow to form hair into a desired shape or style.

A hair straightener utilises heated plates attached to pivoted arms which can be held, by a user, in a closed position with a tress of hair clamped between the heated plates. The tress of hair can be styled into a changed shape once the hair is heated above a transition temperature.

Whilst a hair tress is gripped between closed arms of a hair straightener and subjected to high temperatures from the heated plates, there is a possibility of heat damage to the hair. Also, a tress of hair gripped between two flat and rigidly fixed heating plates is forced to splay widely across the plates, which is detrimental when styling hair into straight, even tresses. Further, hair is a thermal insulator and therefore transfer of heat from the heated plates into the centre of a hair tress is poor. It is therefore desirable to provide an improved hair styling apparatus.

SUMMARY

A first aspect of the present invention provides a hair styling apparatus comprising a first arm and a second arm coupled together at a first end thereof, wherein an inner wall of the first arm is facing an inner wall of the second arm, and the first arm and the second arm are arranged to receive hair within a cavity formed between the first arm and the second arm, and wherein at least one of the first arm and second arm comprise a plenum, said plenum comprising an air inlet for receiving airflow from a fan unit and an air outlet for emitting airflow towards hair within the cavity, wherein said air outlet extends along the inner wall of at least one of the first arm and the second arm.

The fan unit in the hair styling apparatus may generate around 3.5-3.9 kPa of pressure to create high velocity and high pressure airflow through the apparatus from the central body to the plenum in each arm.

In respect of the present apparatus, a plenum refers to a chamber having an inlet and an outlet and an air pressure greater than atmospheric pressure within the chamber.

Preferably, the air outlet comprises an aperture, and the aperture may have a width in the range from 1 mm and 3 mm. More preferably, the aperture may have a width in the range from 1.5 mm and 2.5 mm.

Preferably, the aperture may have a length in the range from 90 mm and 180 mm.

Advantageously, the laminar, blade-like airflow exiting the aperture also improves alignment of individual hair strands within the tress of hair.

In a preferred embodiment, the aperture is a slot and the slot may be located in parallel alignment with the longitudinal axis of the arm and is disposed in proximity to an upper edge of the arm.

Preferably, the air outlet is adapted to emit airflow generally towards a lower edge of the arm. In a preferred embodiment the air outlet is adapted to emit airflow at an angle in the range from 30° and 60° from the plane of the inner wall. More preferably still, the air outlet is adapted to emit airflow at an angle in the range from 40° and 50° from the plane of the inner wall. Advantageously, when such downward airflow interacts with a hair tress, the hair cuticles (which form the external surface of a strand of hair), are urged downwards and thus lie flat on the hair shaft. Therefore, the hair strand has a smoother surface which results in a hair style with improved shine.

The air outlet may comprise a channel between the plenum and the cavity, said channel terminating in said aperture. The channel may have substantially parallel walls for a pre-determined distance prior to the air outlet. Alternatively, the channel may have gradually converging walls for a pre-determined distance prior to the air outlet.

A terminus of the inner wall at the aperture has a smooth, rounded configuration in order to turn the airflow efficiently as it exits the plenum and enters the channel. Advantageously, airflow within the plenum may attach to the rounded terminus of the inner wall and increase in velocity as it passes through the relatively narrow aperture channel.

In a preferred embodiment, the air outlet comprises at least one vane disposed within the channel. The at least one vane may be adapted to modify the emitted airflow direction in the x-axis of the apparatus.

Further, a series of vanes may be disposed at intervals along the aperture, within the channel. Advantageously, the series of vanes functions both to direct the laminar airflow in a preferred direction and also to provide structural rigidity along the length of the aperture. Such structural support maintains the original slot dimension even where torsion forces are applied to the apparatus arms or high temperatures lead to plasticity of components.

The aperture may have a constant width along the length of the air outlet. Alternatively, the aperture may have a non-constant width along the length of the air outlet.

Preferably, the air outlet is located in each of the first arm and the second arm. The air outlets may be located symmetrically in each of the first arm and the second arm. Alternatively, the apertures may be located asymmetrically in each of the first arm and the second arm.

The high velocity, heated airflow in such a hair styling apparatus uses convection to heat the hair tress and thermal transfer is even throughout the tress. The airflow temperature in the drying cavity may be around 130-170° C., and preferably around 140-160° C. Therefore, modifying the hair shape into straight strands can be achieved at a lower temperature than regular hair straightener using heated plates. Airflow through the cavity has a flow rate of approximately 4-12 litres per second dependent upon the primary effect required by the user. Specifically, a higher flow rate is advantageous to reduce water content of a wet tress, whilst a lower flow rate (combined with a higher temperature) is advantageous to shape the hair strands. In use, the hair styling apparatus both dries and straightens a hair tress simultaneously.

Advantageously, characteristics of the airflow exiting the apertures can be precisely determined by controlling the power of the fan unit and the form of the apertures including any vanes therein.

A second aspect of the present invention provides a hair styling apparatus comprising a first arm and a second arm coupled together at a first end thereof wherein an inner wall of the first arm is facing an inner wall of the second arm, wherein the first arm and the second arm are arranged to receive hair within a cavity formed between the first arm and the second arm, and wherein at least one of the first arm and second arm comprise a plenum, said plenum comprising an air outlet for emitting air towards hair within the cavity, and a hair clamp comprising a pair of clamping members for gripping hair therebetween, wherein each clamping member is supported by the inner wall of the first arm and second arm, respectively.

Each clamping member may comprise a clamping face for contacting hair.

Preferably, each clamping member is adapted to move relative to the arm upon which it is supported, between an extended position and a retracted position, and the movement is biased towards the extended position.

When the hair styling apparatus is not in use and the arms are in an open position, the hair clamping members are in an extended position. When the hair styling apparatus is in use and the arms are squeezed into a closed (parallel) position by the user, the hair clamping members are pushed into a retracted position.

Preferably, in the extended position, the distance between the pair of clamping faces is less than the distance between the inner wall of the first arm and the inner wall of the second arm.

In a preferred embodiment, each clamping member comprises an elongate bar extending longitudinally on the inner wall of the respective arm. Each clamping member may be comprised of a metallic material. Alternatively, each clamping member may be comprised of a resiliently deformable material.

The inner walls may be comprised of a plastics material which may increase in temperature whilst the hair styling apparatus is in use, but returns to the ambient temperature when the apparatus is not in use. Alternatively, the inner walls may be comprised of an anodised metal.

Preferably, each clamping member is located in parallel alignment with the arm and is disposed in proximity to an upper edge of the arm. Each arm may comprise a groove extending longitudinally along the inner wall of the arm, and the clamping member is mounted partially within said groove. A resilient means may be disposed within the groove and the clamping member is positioned on the resilient means. Preferably, the resilient means is at least one spring. The resilient means may also be at least one silicone support.

In a preferred embodiment, each clamping member has a straight longitudinal profile. Alternatively, each clamping member has a concave longitudinal profile.

Preferably, the first arm and the second arm are coupled together via a hinge to allow the first arm and the second arm to be moveable between an open position, and a closed position in which the inner wall of the first arm and the inner wall of the second arm are parallel to one another and the hair treatment cavity is formed therebetween.

The arms and central body may be elastically secured to one another, enabling the arms to be biased into the open position and also smoothly closeable by the user.

The inner walls may be comprised of a plastics material which may increase in temperature whilst the hair styling apparatus is in use, but returns to the ambient temperature when the apparatus is not in use. Alternatively, the drying cavity wall may be comprised of an anodised metal.

In a preferred embodiment, the first arm and the second arm are symmetrical in structure and substantially identical in weight, and also the central body is substantially symmetrical in structure about the longitudinal central axis of the hair styling apparatus. Advantageously, such a symmetrical, balanced arrangement increases ergonomic comfort for the user, because a balanced apparatus may minimise a user's hand and arm strain, and also be perceived as a lighter in weight in comparison to an unbalanced apparatus.

Advantageously, a tress styled and dried in this way comprises generally aligned strands of hair which have been straightened primarily by high pressure airflow. Importantly, the hair tress has increased volume, resulting from the airflow between the strands, which is a desirable feature in hair styling. In contrast, a traditional straightening iron reduces the volume of a hair tress as the tress is squeezed between two rigid, heated plates.

The hair styling apparatus may be battery operated or powered via the mains electricity supply.

BRIEF DESCRIPTION OF THE FIGURES

In order that the present invention may be more readily understood, an embodiment of the invention will now be described, by way of example, and with reference to the accompanying drawings, in which.

DETAILED DESCRIPTION

Figure 1A:
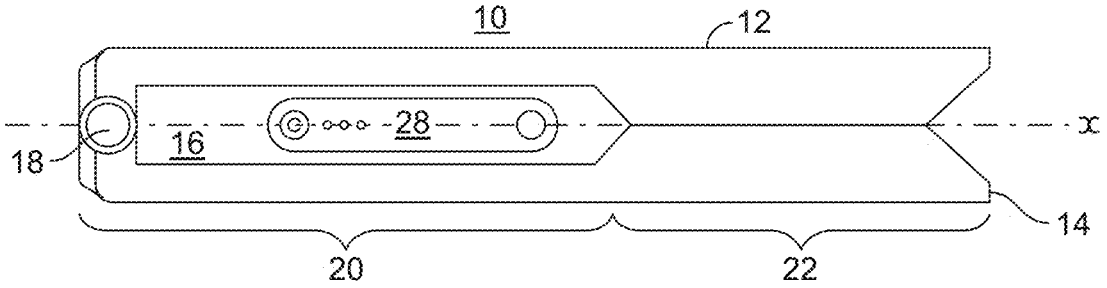
FIG. 1*a* is a plan view of a hair styling apparatus with a first arm and a second arm in a closed position, according to the present invention.
Figure 1B:
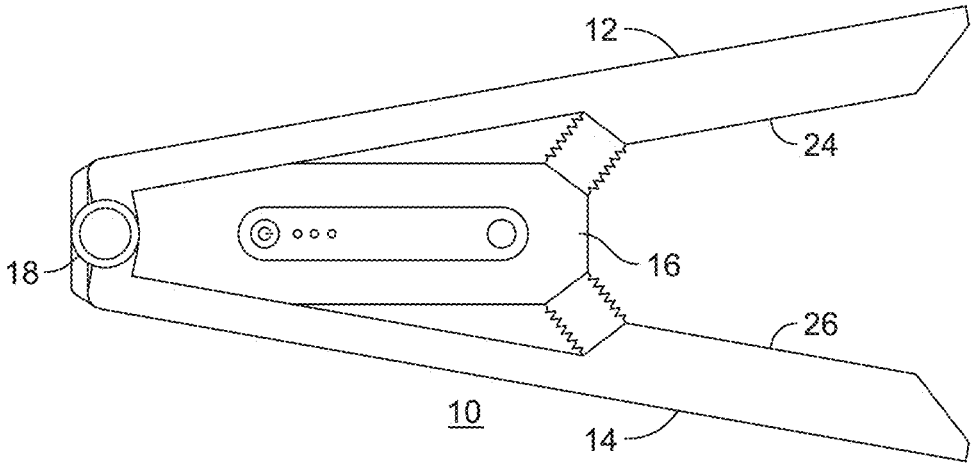
FIG. 1*b* is a plan view of the hair styling apparatus shown in FIG. 1*a*, with the arms in an open position.

A hair styling apparatus 10, as shown in FIGS. 1*a* and 1*b*, comprises a first arm 12, a second arm 14 and a central body 16, which are pivotally joined together at one end by a hinge 18. The hair styling apparatus 10 comprises a handle section 20 towards the hinge end of the arms and a hair treatment section 22 towards the distal end of the arms. The hair treatment section 22 comprises a wall 24, 26 on a facing surface of at least one of the arms. The wall 24, 26 has at least one aperture and the at least one aperture is an air outlet producing a directional laminar airflow. A user interface 28 is provided on a top face of the central body 16 of the hair styling apparatus.

In order to achieve a high-velocity heated airflow exiting the at least one aperture, the apparatus requires one or more motors to produce a high pressure airflow, and one or more heaters to heat the airflow.

Figure 2:
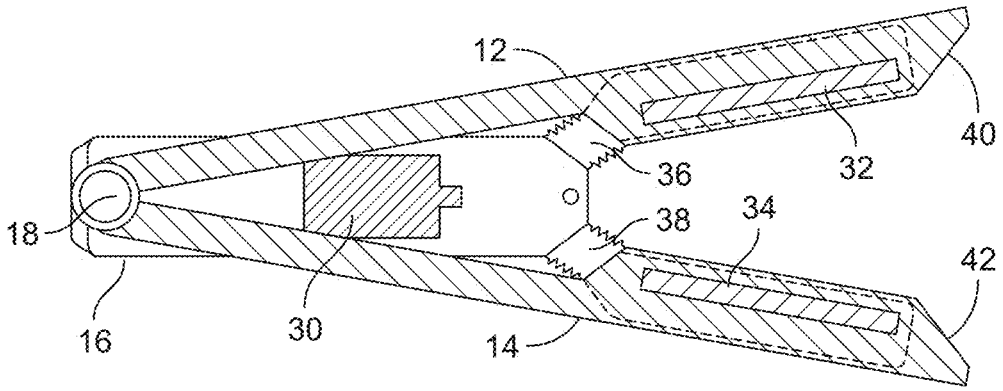
FIG. 2 is a schematic illustration including the main components in the hair styling apparatus.

FIG. 2 schematically illustrates a preferred apparatus arrangement having a motor 30 located within the central body 16 and a heater 32, 34 located within the hair treatment section of each arm. The first and second arms 12, 14 are connected to the central body via first and second conduits 36, 38, respectively. High-pressure airflow produced by the motor 30 passes through the first and second conduit 36, 38, and into a first and second plenum 40, 42, respectively. The first and second plenum 40, 42 are housed within the first and second arm 12, 14, respectively. The airflow passes over the heater 32, 34 in the plenum, prior to exiting the plenum via the aperture in the respective arm 12, 14.

Figure 3A:
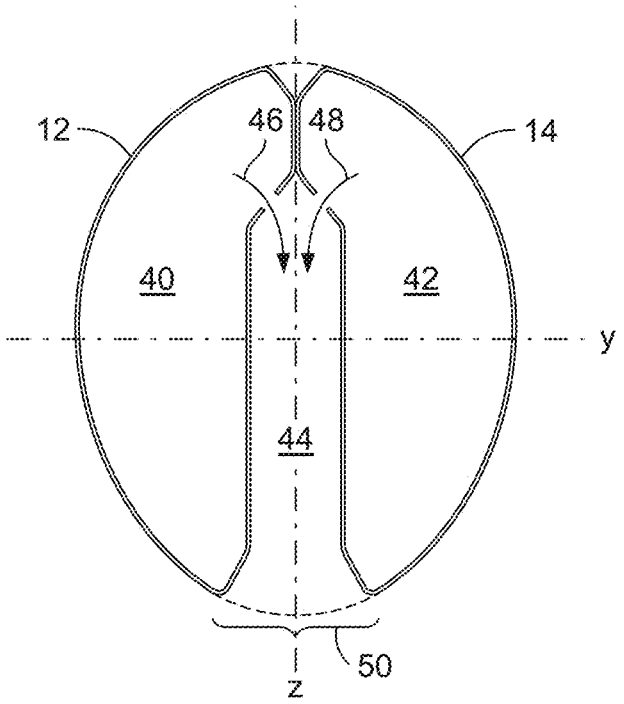
FIG. 3*a* is a schematic transverse sectional view through a hair treatment section of the hair styling apparatus.

FIG. 3*a* schematically illustrates a transverse cross-section through the first and second arms 12, 14 in the closed position and shows a hair drying cavity 44 therebetween. The drying cavity 44 extends for the majority of the length of the hair treatment section 22. Arrows indicate the airflow passing from the first and second plenum 40, 42, through symmetrically positioned apertures 46, 48, and into the drying cavity 44. The drying cavity 44 functions as an expansion chamber for the incoming high pressure airflow. The expanded airflow exits the drying cavity via an exhaust port 50.

The width of the drying cavity, as measured along the y-axis of the apparatus, is a parameter which determines the available volume in which a hair tress may move. Movement of the tress separates the strands of hair, thereby revealing a greater surface area of hair exposed to the airflow, which results in a shorter time period for drying the tress.

The exhaust port 50 at the lower end of the drying cavity also functions as an outlet for moisture droplets.

The height of the drying cavity 44, as measured along the z-axis, is a factor in determining the temperature of the airflow at the exhaust port 50. Increasing the height of the drying cavity 44 may increase the temperature difference between the apertures 46, 48 and the exhaust port 50. Thus, modifying parameters of the airflow temperature at the inlet apertures and the dimensions of the drying cavity enable airflow temperature at the exhaust port to be controlled. Specifically, the airflow temperature beyond the exhaust port should be comfortable for a user to experience on their skin.

Figure 3B:
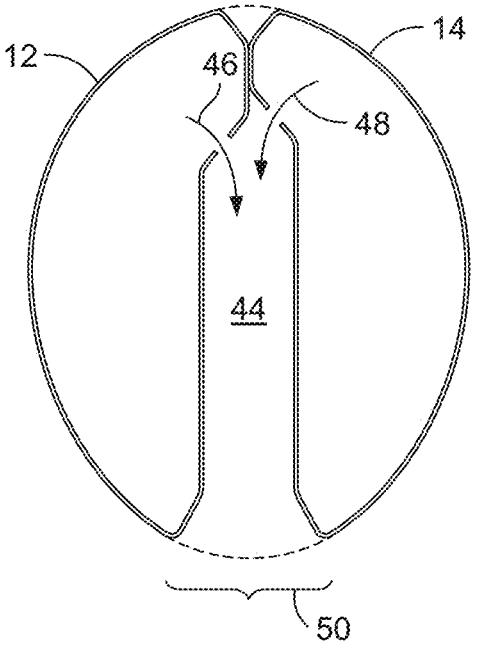
FIG. 3*b* show a schematic sectional view through an alternative embodiment of a hair treatment section.

FIG. 3*b* schematically illustrates an alternative, asymmetrical configuration of the apertures 46, 48. Such asymmetrical aperture positions encourage a more turbulent airflow pattern within the drying cavity 44 in comparison to symmetrical aperture positions. Advantageously, greater turbulence in the airflow in the drying cavity decreases the time required to dry a wet hair tress.

Figure 4A:
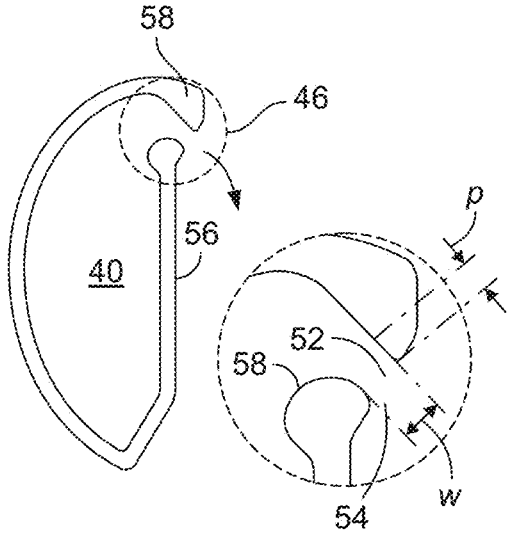
FIGS. 4*a* and 4*b* show various aperture profiles.

The aperture profile determines the exit angle and velocity of the airflow. As schematically illustrated in FIG. 4*a*, the air outlet 46 is located towards an upper portion of an arm and functions to direct the airflow generally downwards. The air outlet 46 comprises a channel 52 from the plenum 40, terminating in an aperture 54 into the drying cavity 44. The channel 52 is formed between the drying cavity wall 56 and an upper plenum wall 58. Preferably, the channel 52 has a constant width for a distance, p, extending directly from the aperture 54. In other words, the channel 52 has parallel sides.

In a preferred embodiment, the width, w, of the aperture 54, is approximately 1-3 mm, and extends lengthways along the arm 12 throughout the hair treatment section 22. More preferably, the width, w, of the aperture 54, is approximately 1.5-2.5 mm. More preferably still, the width, w, of the aperture 54, is approximately 2 mm.

Figure 4B:
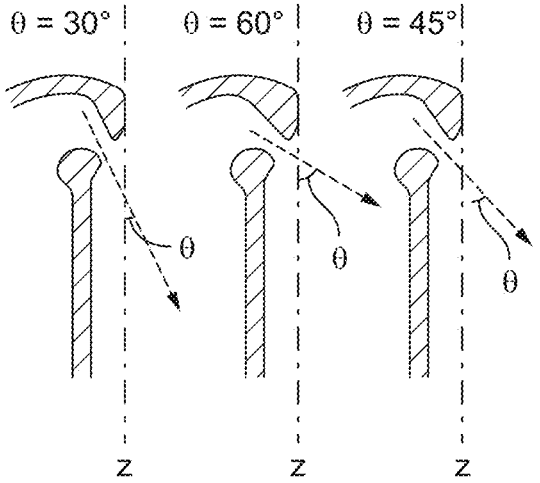

The exit angle, Θ, of the laminar airflow, relative to the z-axis, is a critical factor in how effectively the apparatus dries and styles a hair tress. As illustrated in FIG. 4*b*, suitable exit angles, Θ, include 30°, 60° and 45°. A terminus 58 of the drying cavity wall 56 has a smooth, rounded configuration in order to turn the airflow efficiently as it exits the plenum 40 and enters the channel 52. Specifically, the radius of the terminus 58 of the drying cavity wall primarily determines the airflow exit angle, Θ.

Figure 5A:
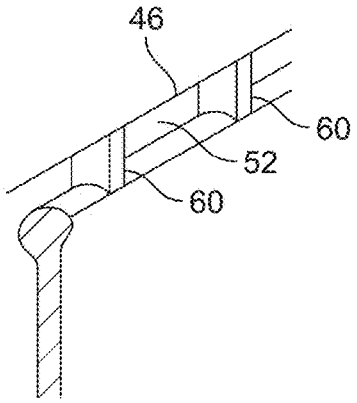
FIGS. 5*a* and 5*b* show an aperture with vanes in a perspective view and sectional views, respectively.
Figure 5B:
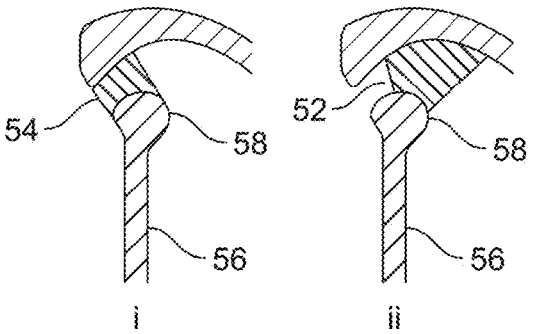

The air outlet 46 is a slot which extends for the majority of the length of the hair treatment section 22. As shown in FIG. 5*a*, a series of vanes 60 are disposed at intervals along the air outlet 46, within the channel 52. Each vane 60 is located directly at the aperture 54 into the drying cavity 44 or set back within the channel 52, as illustrated in FIGS. 5*bi* and 5*bii*, respectively. Each vane 60 may be disposed perpendicular to the slot, and therefore the vanes 60 would direct the laminar airflow in a similar, perpendicular orientation. Alternatively, the vanes 60 may be angled to control the orientation of the laminar airflow. For example, turning the vanes, and consequently the airflow, towards a middle point of the hair treatment section may function to corral a hair tress into a central portion of the hair treatment section 22.

Figure 6A:
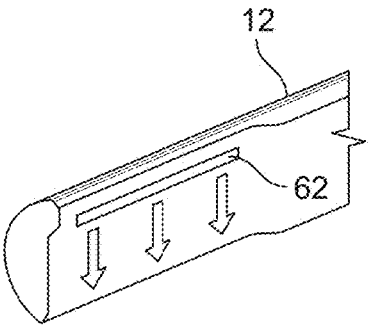
FIGS. 6*a*, 6*b* and 6*c* show a sectional view through alternative embodiments of a hair treatment section.
Figure 6B:
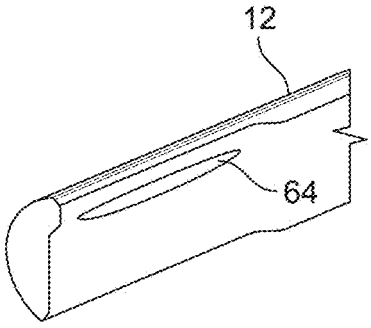
Figure 6C:
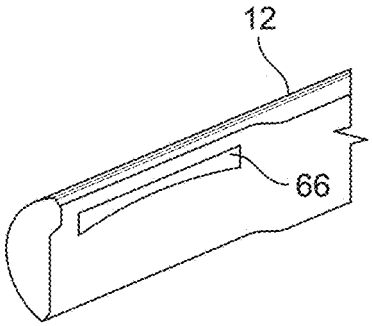

The aperture may be a rectangular slot 62, as shown in FIG. 6*a*, which produces a laminar airflow having a consistent velocity at each location along the length of the slot. FIG. 6*b* illustrates an ellipse shaped aperture 64 which functions to produce a laminar airflow having a relatively lower velocity in the wider central portion and an increasing velocity towards the narrower aperture ends. Advantageously, such a slot shape may function to corral the hair tress towards the central portion of the hair treating section. An inverse arrangement is shown in FIG. 6*c*, namely, a slot 66 having a relatively narrower outlet in the central portion which widens at the aperture ends and therefore, functions to produce a laminar airflow having a relatively higher velocity in the central portion and a decreasing velocity towards the aperture ends. Such an arrangement may function to distribute a wet hair tress more evenly along the hair treating section.

Figure 7A:
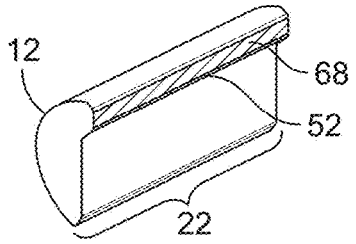
FIG. 7*a* schematically shows a perspective view of an arm of the hair styling apparatus comprising a hair clamp.
Figure 7B:
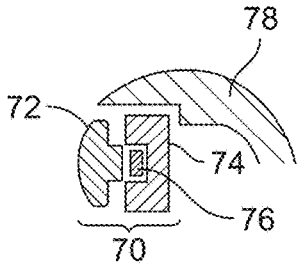
FIG. 7*b* is a transverse sectional view through a hair clamp arrangement.

The first arm 12 and the second arm 14 of the hair styling apparatus, comprise a first hair clamp 68 and a second hair clamp 70, respectively. The first hair clamp 68 extends along the first arm 12 parallel to the aperture 52, as shown in FIG. 7*a*, and along the majority of the length of the hair treating section 22. FIG. 7*b* schematically illustrates a hair clamp 70 which comprises a hair clamp head 72 supported in a U-shaped hair clamp chassis 74 and a biasing means 76 therebetween. The biasing means 76 may comprise a series of discrete silicone plugs located in a groove within the hair clamp chassis 74. The hair clamp 70 is adjacent to a top edge of a shell 78 of the arm 14.

Figure 7C:
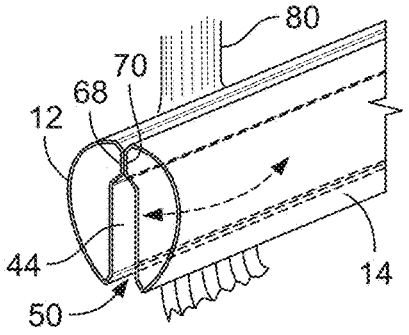
FIG. 7*c* shows a front perspective view of the hair treating section and illustrates movement of a hair tress held between closed arms of the hair styling apparatus.

In use, the first and second elongate hair clamps 68, 70 function together to hold the hair tress 80 in the correct position between the arms 12, 14 of the hair styling apparatus, as seen in FIG. 7*c*. Advantageously, the hair tress 80 is held firmly by the hair clamp heads, but without a force that could damage hair strands. Even if the user imparts a relatively high compressive force on the handle section of the hair styling apparatus, the biasing means functions to mitigate the compressive forces being transferred into the hair tress 80.

A section of the hair tress 80 directly below the hair clamp 68, 70 is constrained within the drying cavity 44 and has a limited freedom of movement within the volume of the drying cavity 44. The hair clamp also functions to gently squeeze water droplets from the tress of hair. Such excess water removed from the hair tress in this way, will fall through the drying cavity and exit the apparatus. Further, the hair clamp functions to spread a wet, clumped hair tress into a wider, laminar form which can be more efficiently dried and styled.

The hair clamp head 72 is formed of a metal, such as aluminium, and has a coating on the smooth hair contacting surface. Moisture and/or temperature sensors can be integral to the hair clamp or directly adjacent to the hair clamp.

The first and second hair clamps 68, 70 have identical dimensions which comprise a length of between 80 mm and 180 mm in length, and extend for approximately the length of drying cavity. The first and second hair clamps may have a height of between 5 mm and 15 mm.

Figure 8A:
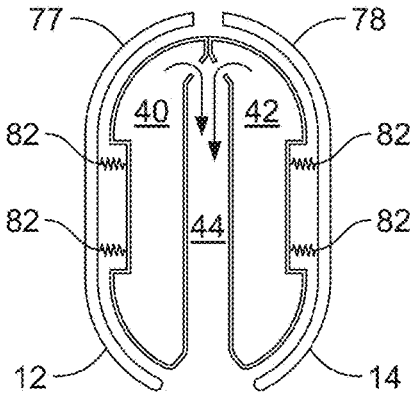
FIGS. 8*a*, 8*b*, 8*c* and 8*d* show sectional views through alternative embodiments of the hair treatment section.
Figure 8B:
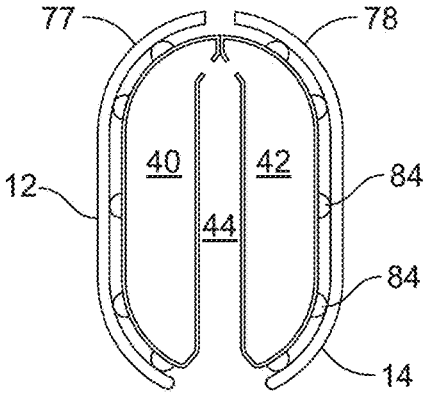

As described previously, high pressure airflow produced by the motor within the central body is directed into the first and second plenums 40, 42. The first and second plenums are generally symmetrical in form and identical in volume. The first and second plenums 40, 42 may be mobile or static with respect to the shell of the first and second arm, respectively. FIGS. 8*a* and 8*b* illustrate two alternative methods by which each plenum 40, 42 may be held in a mobile and resilient relationship with the shell 77, 78 of the first and second arm 12, 14, respectively. One or more biasing means, such as coil springs 82 (shown in FIG. 8*a*) or silicon beads 84 (shown in FIG. 8*b*) or leaf springs, are located between an outer surface of the plenum 40, 42 and an adjacent inner surface of the respective shell 77, 78. Such biasing means may be attached to the plenum surface or the shell surface or both. In such embodiments, the hair clamp head can be integral to the plenum.

Figure 8C:
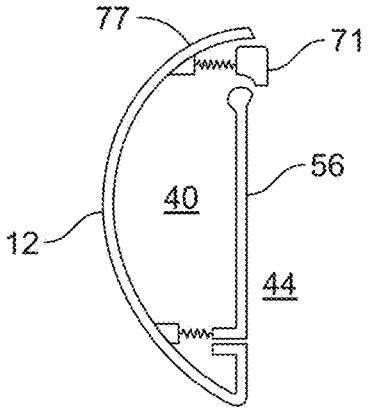

In an alternative embodiment, the hair clamp head 71 and cavity wall 56 are independently held in a mobile and resilient relationship with the shell 77, as shown in FIG. 8*c*. Advantageously, such an integrated arrangement simplifies the internal structure of the hair styling apparatus and may reduce the weight of the apparatus.

Figure 8D:
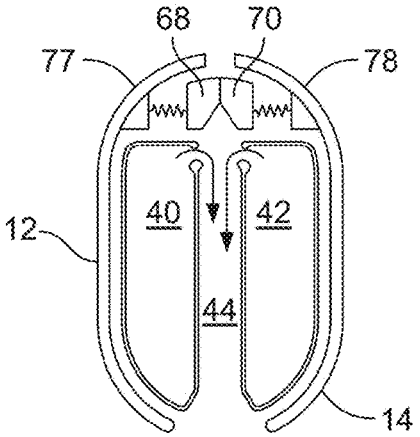

In a yet further alternative, the plenum 40, 42 is static with respect to the shell 77, 78 of the respective arm 12, 14, and the hair clamp 68, 70 is sprung with respect to the shell of the respective arm, as schematically illustrated in FIG. 8*d*.

The shell may be comprised of a liquid crystal polymer (LCP) material or a toughened nylon. Alternatively, the shell may be comprised of a rigid metal layer, over moulded in a plastics material.

Figure 9A:
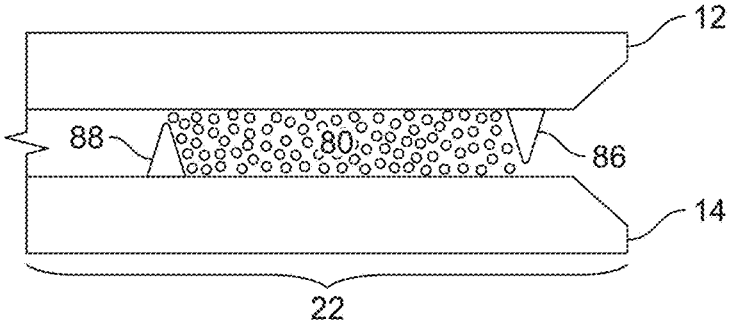
FIGS. 9*a*, 9*b*, 9*c* and 9*d* illustrate various embodiments of a corralling feature.

It is advantageous to corral the hair tress 80 between the arms 12, 14 of the hair styling apparatus 10 and within a predetermined region of the hair treatment section 22, because this ensures that all hair strands are retained in proximity to the apertures 46, 48 and uniformly treated, and reduces "fly away" hairs. Several embodiments of a corralling means are disclosed in FIGS. 9*a* to 9*d* and illustrated from a plan view. A first protrusion 86 from an inner face of the first arm 12 at the distal end of the hair treatment section 22 and a second protrusion 88 from an inner face of the second arm 14 towards the hinge end of the hair treatment section 22, is illustrated in FIGS. 9*a*. The height of the first and second protrusion 86, 88 should be similar in order to effectively restrain the hair tress 80 within the hair treatment section. The height of a protrusion may be between 3 mm and 20 mm and preferably between 8 mm and 15 mm.

Figure 9B:
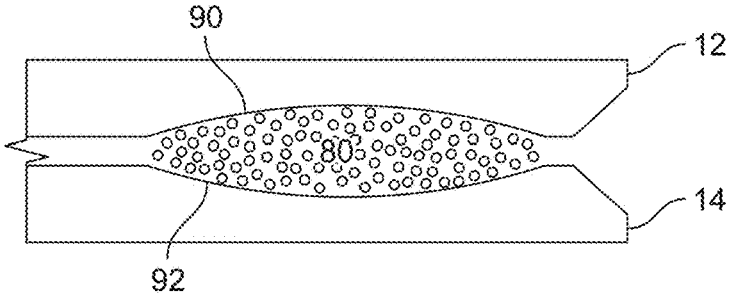
Figure 9C:
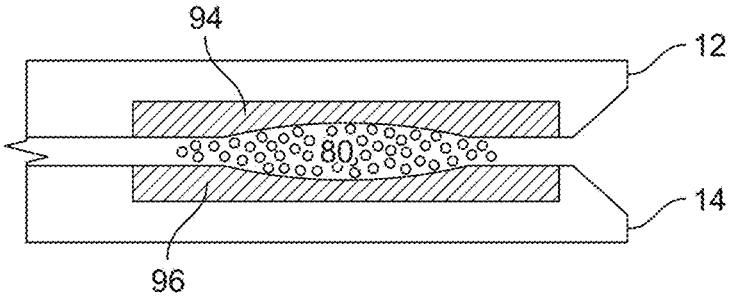

A further corralling means, illustrated in FIG. 9*b*, comprises a first curved hair clamp 90 on the first arm 12 and a second curved hair clamp 92 on the second arm 14. When the first and second arms are in a closed position, then the first and second hair clamp heads 90, 92 together form a generally elliptical shape. Alternatively, the first hair clamp 94 and second hair clamp 96 are comprised of a resilient, deformable material, as schematically illustrated in FIG. 9*c*. Preferably, the resilient material has a lower resistance to deformation towards the middle of the hair treatment section. Consequently, hair strands are urged towards the area of least resistance in the middle of the hair treatment section.

Figure 9D:
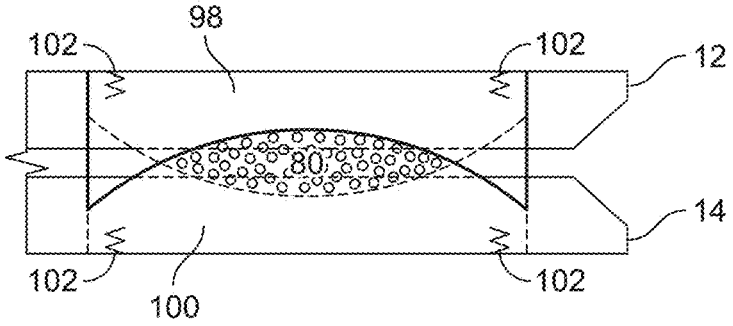

FIG. 9*d* schematically illustrates an arrangement of sprung shutters which comprise a pair of shutters 98, 100 disposed on at least the top side of the hair treatment section 22. Each shutter 98, 100 comprises a curved edge positioned in proximity to the hair clamp arrangement. Each shutter 98, 100 is resiliently attached (by one or more springs 102) to an arm 12, 14 of the hair styling apparatus 10, either inside or outside of the arm shell 77, 78. Each shutter 98, 100 is biased towards an extended position and therefore substantially covers the hair clamp 68, 70 when viewed from a top view of the hair treatment section 22. An ellipse shaped space between a pair of shutters is minimised when no force is exerted on the pair of shutters 98, 100. In use, the arms 12, 14 are initially in the open position, the shutters 98, 100 are in the extended position and a tress of hair 80 is introduced in the hair treatment section 22. Then, the arms 12, 14 are moved to the closed position, the hair tress 80 comes into contact with the shutters 98, 100 forcing them towards a retracted position. The ellipse shaped space between the pair of shutters 98, 100 is increased when the hair tress 80 forces the pair of shutters apart. As a consequence of the curved edge of each shutter, hair strands are corralled towards the middle of the hair treatment section 22. Advantageously, such corralling means minimises individual strands falling outside the hair treatment section.

A pair of shutters 98, 100 may be disposed at the top and bottom sides of the hair styling apparatus 10. Alternatively, a pair of shutters may be disposed at only the top side of the hair styling apparatus. In a further alternative, a single shutter may be disposed on the top side of the apparatus 10. In any disclosed arrangement, a shutter may have a straight edge or a concave, curved edge or a combination of straight and curved edges.

Figure 10:
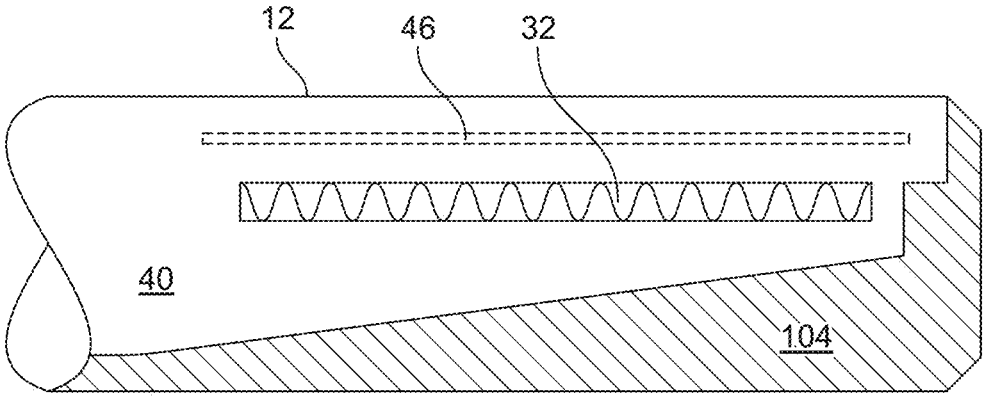
FIG. 10 is a schematic illustration of a longitudinal cross-section through one arm of the hair styling apparatus.

In order to achieve a uniform drying and styling effect along the hair treatment section 22, the airflow exiting the air outlet 46, 48 should have a constant velocity along its length. Therefore, a transverse cross-sectional area of the plenum 40, 42 decreases in size from the air inlet along the length of the hair treating section 22 towards the distal end. Such a gradual reduction in cross-sectional area compensates for the gradual reduction in air pressure (consequent to the increasing distance from the motor). As shown in FIG. 10, a cavity 104 is formed in the arm as the cross-sectional area of the plenum 40 decreases in size towards the distal end. The cavity 104 may function as a coolwall cavity which reduces thermal transfer from the heater to an external surface of the arm, thereby increasing user comfort.

Further, the cavity 104 can be utilised to reduce the acoustic volume of the hair styling apparatus. Applying a layer of felt or similar material on one or more surfaces of the cavity functions to absorb some of the acoustic energy produced by the high pressure airflow passing through the hair treating section 22. Alternatively, the cavity 104 can be filled with acoustic felt or other insulating material.

It will be apparent to the skilled person that various alternatives are possible within the scope of the present invention. Dimension p in FIG. 4*a* indicates a portion of the channel having parallel sides. In an alternative embodiment, the channel of the aperture may have a tapering profile in portion p. Consequently, the outlet airflow velocity would be increased, in comparison with a channel having parallel sides of a similar initial separation.

The series of vanes illustrated in FIG. 5*a* may be disposed at regular intervals along the aperture, or alternatively, at predetermined, non-regular intervals. Such non-regular spacing can achieve a required airflow pattern or provide enhanced structural support in areas prone to, for example, torsion forces or greater thermal energy build up.

With respect to FIG. 7*a*, the biasing means may alternatively be a leaf spring attached between the outer surface of the plenum and the inner surface of the shell. The leaf spring may be integrally formed with the shell. The biasing means may alternatively be a plurality of discrete rubber protrusions on the outer surface of the plenum or the inner surface of the shell.

Alternatively, the hair clamp head may be integral to the structure of the plenum as indicated in FIGS. 8*a* and 8*b*. In particular, such an arrangement is suitable when the plenum 40, 42 is mobile and biased with respect to the respective arm shell 77, 78. In this way, the surface of the hair clamp head 72 remains the hair contacting surface, but the associated biasing means is attached to the plenum instead of a spring chassis 74.

Figure 11:
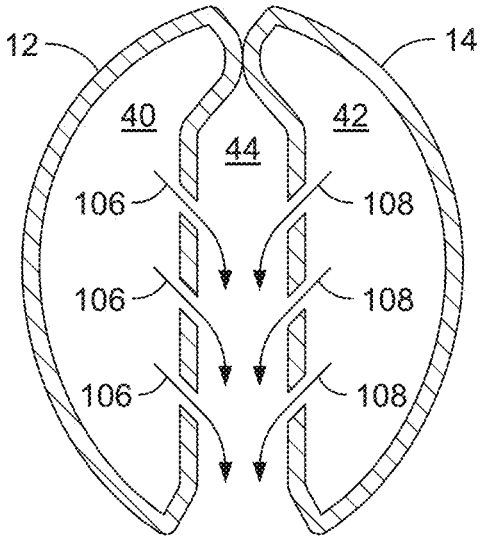
FIG. 11 shows a schematic sectional view through an alternative embodiment of a hair treatment section.

FIG. 11 schematically illustrates an alternative arrangement of air outlets from the plenum 40, 42 into the hair drying cavity. Specifically, each plenum 40, 42 may have a plurality of air outlets in the form of slot apertures 106, 108 disposed parallel to one another. In an alternative embodiment, the air outlets may comprise one or more rows of discrete apertures. Such discrete apertures may have any suitable shape, but the aperture profile in transverse cross-section should have a downwardly angled outlet channel (as illustrated in FIG. 4*a*). In each arrangement, the air outlets may be symmetrical or asymmetrical. An asymmetrical arrangement increases air turbulence within the cavity 44 which may aid airflow penetration of a damp hair tress. However, in order to provide a maximum velocity of airflow exiting each plenum, a single air outlet from each plenum is preferable.

Figure 12A:
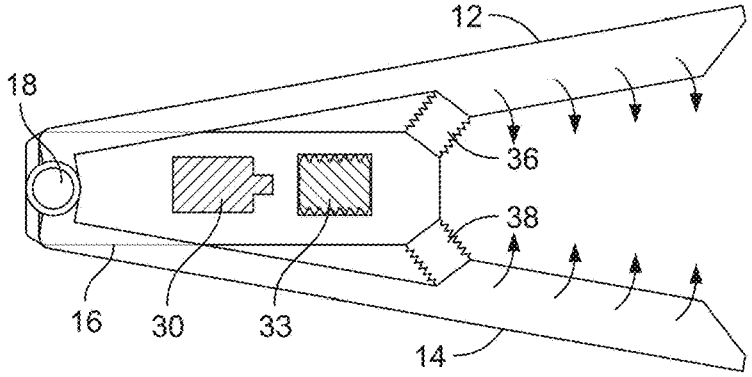
FIGS. 12*a*, 12*b*, 12*c* and 12*d* show schematic illustrations of further alternative embodiments of the hair styling apparatus.
Figure 12B:
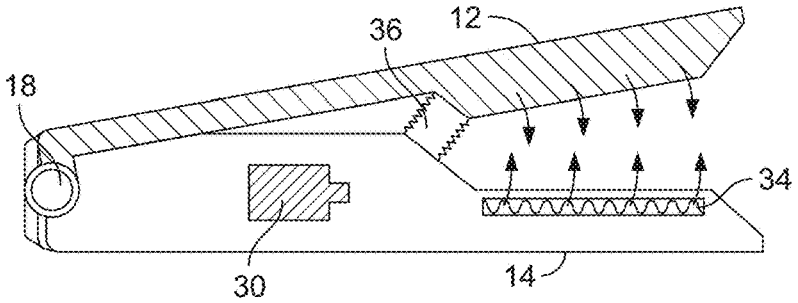

FIGS. 12*a* to 12*d* show various arrangements of motors and heaters suitable for achieving the airflow required for the present hair styling apparatus 10. Such arrangements include a single motor 30 and a single heater 33 in series in the central body 16, in fluid connection with an air outlet in each arm 12, 14, as shown in FIG. 12*a*. In FIG. 12*b*, the central body 16 and second arm 14 are integrated into a single entity. A motor 30 is positioned in the central body 16, and the central body is in fluid connection with the both the first and second arms 12, 14. However, only the second arm 14 comprises a heater 34.

Figure 12C:
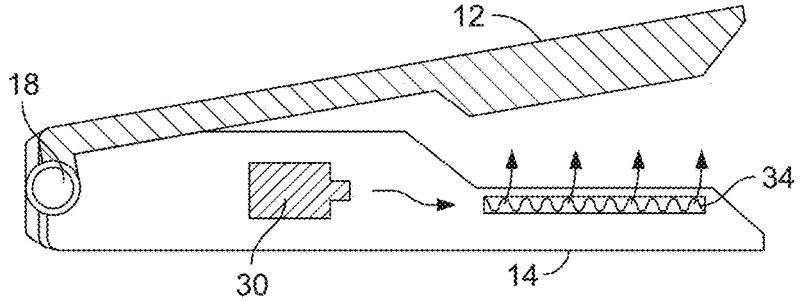

In an alternative arrangement illustrated in FIG. 12*c*, the central body 16 and second arm 14 are integrated into a single entity. A motor 30 is positioned in the central body 16, and the central body is in fluid connection with the second arm 14 only. Only the second arm comprises a heater 34 to heat the airflow. The first arm comprises a hair clamp head and functions to mechanically secure the hair tress. Further, the first arm 12 comprises a drying cavity wall and therefore functions to form the drying cavity 44.

Figure 12D:
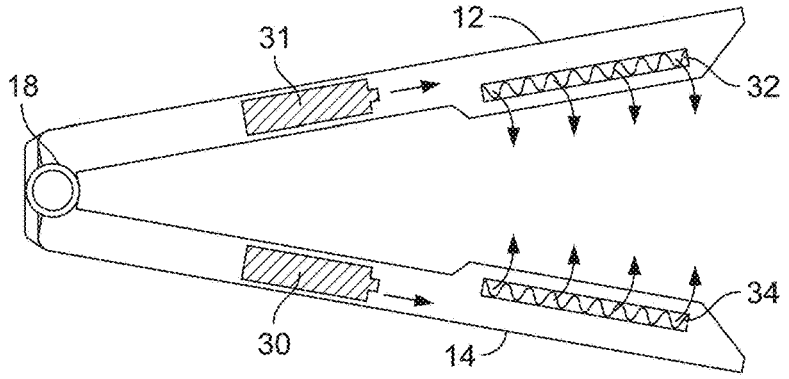

In a yet further embodiment, each of the first and second arms 12, 14 comprise a motor 30, 31 within the handle section 20 and a heater 32, 34 within the hair treatment section 22. Each of the first and second arms 12, 14 also comprise outlet apertures in the hair treatment section 22. A central body is not required in this arrangement, as illustrated in FIG. 12*d*.

In a yet further alternative embodiment, a first arm and a second arm may be fixed in a position parallel to one another, and a drying cavity is formed between the arms within the hair treatment section. A hair clamping arrangement has two hair clamp heads which are moveable relative to the first and second arms. Each elongate hair clamp head has a retracted position, in which it is approximately aligned with the adjacent drying cavity wall. Further, each hair clamp head has an extended position, in which it is in close proximity to the other hair clamp head. In use, a hair tress is inserted between the arms and passing through the drying cavity. The hair clamp heads are moved from the retracted position into the extended position, thereby gently hair clamping the hair tress between them. In the extended position, the hair clamp heads have an elastic and resilient movement to enable the hair tress to be moved through the hair clamp heads, as the user draws the apparatus down the hair tress. The hair clamps may be moved between the retracted position and the extended position via an automated or manual actuator.

The invention is not limited to the detailed description given above. Variations will be apparent to the person skilled in the art.

The invention claimed is:

1. A hair styling apparatus comprising;

a first arm and a second arm coupled together at a first end thereof, wherein an inner wall of the first arm faces an inner wall of the second arm, each inner wall having an upper edge and a lower edge, wherein the first arm and the second arm are arranged to receive hair within a cavity formed between the first arm and the second arm, the hair extending through the cavity in a first direction from the upper edges of the inner walls toward the lower edges of the inner walls, wherein at least one of the first arm and the second arm comprise a plenum, the plenum comprising an air inlet for receiving airflow from a fan unit and an air outlet for emitting airflow towards hair within the cavity, wherein the air outlet extends along the inner wall of the at least one of the first arm and the second arm, wherein the air outlet is adapted to emit airflow out of the air outlet at an angle in the range from 30° and 60° from a plane of the inner wall, wherein the air outlet, the inner wall of the first arm, and the inner wall of the second arm are configured to direct airflow out of the cavity along the first direction.

2. The hair styling apparatus according to claim 1, wherein the air outlet comprises an aperture, wherein the aperture has a width in the range from 1 mm and 3 mm.

3. The hair styling apparatus according to claim 2, wherein the width of the aperture is in the range from 1.5 mm and 2.5 mm.

4. The hair styling apparatus according to claim 2, wherein the aperture has a length in the range from 90 mm and 180 mm.

5. The hair styling apparatus according to claim 2, wherein the aperture is a slot.

6. The hair styling apparatus according to claim 2, wherein the at least one of the first arm and the second arm has a length extending along a longitudinal axis, wherein the aperture is located in parallel alignment with the longitudinal axis and is disposed in proximity to the upper edge of the of the inner wall of the at least one of the first arm and the second arm.

7. The hair styling apparatus according to claim 2, wherein the air outlet comprises a channel between the plenum and the cavity, said channel terminating in said aperture.

8. The hair styling apparatus according to claim 7, wherein the channel has substantially parallel walls for a pre-determined distance prior to the air outlet.

9. The hair styling apparatus according to claim 7, wherein the channel has gradually converging walls for a pre-determined distance prior to the air outlet.

10. The hair styling apparatus according to claim 7, wherein the air outlet comprises at least one vane disposed within the channel.

11. The hair styling apparatus according to claim 10, wherein the at least one vane is adapted to modify the emitted airflow direction in an x-axis of the apparatus.

12. The hair styling apparatus according to claim 2, wherein the aperture has a constant width along the length of the air outlet.

13. The hair styling apparatus according to claim 2, wherein the aperture has a non-constant width along the length of the air outlet.

14. The hair styling apparatus according to claim 1, wherein the air outlet is adapted to emit airflow generally towards the lower edges of the inner walls.

15. The hair styling apparatus according to claim 1, wherein the angle at which the air outlet is adapted to emit the airflow is in the range from 40° and 50° from the plane of the inner wall.

16. The hair styling apparatus according to claim 1, wherein the air outlet is located in each of the first arm and the second arm.

17. The hair styling apparatus according to claim 16, wherein the air outlets are located symmetrically in each of the first arm and the second arm.

18. The hair styling apparatus according to claim 16, wherein the air outlets are located asymmetrically in each of the first arm and the second arm.

19. The hair styling apparatus according to claim 1, wherein the first arm and the second arm are movable between an open position and a closed position in which the inner wall of the first arm and the inner wall of the second arm are parallel along a plane, and wherein the cavity is formed when the first arm and the second arm are in the closed position.

* * * * *